US006991438B2

(12) United States Patent
Blessing et al.

(10) Patent No.: US 6,991,438 B2
(45) Date of Patent: Jan. 31, 2006

(54) RADIAL PISTON PUMP WITH PISTON ROD ELEMENTS IN ROLLING CONTACT WITH THE PUMP PISTONS

(75) Inventors: Gerd Blessing, Göppingen (DE); Swen Fleisch, Stuttgart (DE); Karl-Heinz Hoffmann, Stuttgart (DE); Manfred Müller, Kornwestheim (DE); Claus Stenger, Stuttgart (DE); Bernd Wiemann, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 180 days.

(21) Appl. No.: 10/393,444

(22) Filed: Mar. 20, 2003

(65) Prior Publication Data

US 2003/0180159 A1 Sep. 25, 2003

(30) Foreign Application Priority Data

Mar. 21, 2002 (DE) ..... 102 12 492

(51) Int. Cl.
*F04B 1/04* (2006.01)

(52) U.S. Cl. ..... 417/273; 417/470; 417/471; 92/72; 92/129; 74/55; 74/60; 74/569

(58) Field of Classification Search ..... 417/273, 417/470, 471; 92/72, 129; 74/50, 55, 60, 74/567, 569

See application file for complete search history.

(56) References Cited

U.S. PATENT DOCUMENTS

| | | | | |
|---|---|---|---|---|
| 4,366,747 | A * | 1/1983 | Falendysz et al. | 92/72 |
| 4,498,372 | A * | 2/1985 | Pareja | 92/187 |
| 4,538,965 | A * | 9/1985 | Dantlgraber et al. | 417/273 |
| 4,690,620 | A * | 9/1987 | Eickmann | 417/273 |
| 5,100,305 | A * | 3/1992 | Zirps | 417/521 |
| 5,876,186 | A * | 3/1999 | Stiefel | 417/273 |
| 6,162,022 | A * | 12/2000 | Anderson et al. | 417/213 |
| 6,176,223 | B1 * | 1/2001 | Kuhn et al. | 123/495 |
| 6,431,842 | B1 * | 8/2002 | Furuta | 417/273 |
| 6,622,706 | B2 * | 9/2003 | Breeden | 123/495 |
| 2002/0081215 | A1 * | 6/2002 | Plaga | 417/273 |
| 2002/0119052 | A1 * | 8/2002 | Ihring et al. | 417/273 |

FOREIGN PATENT DOCUMENTS

| | | |
|---|---|---|
| DE | 28 27 609 | 1/1980 |
| DE | 42 00 576 | 7/1992 |
| DE | 196 35 164 | 3/1998 |
| DE | 198 29 548 | 1/2000 |
| DE | 198 58 862 | 3/2000 |
| DE | 198 46 367 | 4/2000 |
| GB | 574 991 | 1/1946 |

* cited by examiner

*Primary Examiner*—Charles G. Freay
*Assistant Examiner*—Emmanuel Sayoc
(74) *Attorney, Agent, or Firm*—Klaus J. Bach

(57) ABSTRACT

In a piston pump for providing high-pressure fuel in a common-rail fuel injection system including a camshaft (2), which is mounted rotatably in a pump housing (1) and which has at least one eccentric cam 93) for operating a pump piston (4, 14) in an approximately radial direction with respect to the camshaft (2), in order to reduce the wear of the piston pump, a piston-rod element (6, 16, 26, 36, 46) is arranged between each pump piston (4, 14) and the eccentric cam (3) so as to transmit the stroke movement (5) and the force from the eccentric cam of the camshaft (2) to the pump piston (4, 14) by a rolling movement.

26 Claims, 9 Drawing Sheets

RADIAL PISTON PUMP WITH PISTON ROD ELEMENTS IN ROLLING CONTACT WITH THE PUMP PISTONS

The invention relates to a piston pump, particularly a radial piston pump for producing high-pressure fuel in a common rail, high-pressure fuel injection system.

BACKGROUND OF THE INVENTION

In diesel engines, the fuel is injected, atomized as finely as possible, into the combustion chamber of the engine. Piston pumps, in particular radial piston pumps of compact construction, are used for producing the high fuel injection pressure necessary for this purpose. Particularly for common-rail injection systems, use of a radial piston pump having a plurality of pump pistons permits the generation of constant high-pressure fuel supply.

In known radial piston pumps, three pump pistons are generally arranged in a pump housing in the radial direction around a camshaft. An eccentric cam having a central shaft, which is connected to the camshaft of an engine rotates with the camshaft. The rotation of the camshaft causes a polygon ring, which is arranged concentrically with respect to the eccentric cam, to execute a movement in the direction of the longitudinal axis of the pump piston and a transverse movement. The pump piston is pressed toward the polygon ring by a spring. The stroke movement is transmitted from the polygon ring to the pump piston via a piston-end disc. The transverse movement leads to a movement of the polygon ring relative to the piston-end disc. With the large forces, which occur on the basis of the high pressures, this transverse movement leads to increased wear between the piston-end disc and polygon ring. In addition, the high frictional forces decrease the efficiency of known piston pumps.

It is the object of the present invention to provide a high-pressure piston pump for pumping fuel, which is subjected only to low wear during operation.

SUMMARY OF THE INVENTION

In a piston pump for providing high-pressure fuel in a common-rail fuel injection system including a camshaft (2), which is mounted rotatably in a pump housing (1) and which has at least one eccentric cam 93) for operating a pump piston (4, 14) in an approximately radial direction with respect to the camshaft (2), in order to reduce the wear of the piston pump, a piston-rod element (6, 16, 26, 36, 46) is arranged between each pump piston (4, 14) and the eccentric cam (3) so as to transmit the stroke movement (5) and the force from the eccentric cam of the camshaft (2) to the pump piston (4, 14) by a rolling movement thereby reducing friction and wear.

The bearing surface, which faces the eccentric cam, advantageously engages the eccentric cam over an angle of less than 180°. Expediently, a plurality of pump pistons is provided, and the piston-rod elements can be rotated at least in one angular range about the eccentric-cam central axis independently of other piston-rod elements.

The piston-rod element is expediently in contact on one contact surface with the contact surface of the pump piston, with at least one of the contact surfaces being of convex design. This enables a rolling movement to be obtained between the pump piston and piston rod element, with the result that no sliding friction and therefore virtually no wear occurs between the pump piston and piston rod element. By means of the use of the crank-mechanism principle in conjunction with the rolling coupling and transmission of force from the piston-rod element to the pump piston, the sliding friction, which occurs in the prior art, between the polygon ring and piston-end disc is thus avoided, in which case the surface pressure which occurs in the contact surface area between the piston-rod element and the pump piston clearly remains below the permissible limit value because of the large diameters which can be realized for the radii of curvature of the contact partners.

It may be advantageous for one of the contact surfaces to be concave, with the radius of the concave contact surface being greater than the radius of the convex contact surface. The concave and convex contact surfaces roll on each other. The difference between the radii of curvature is as small as possible so as to minimize the surface pressure. However, it may also be advantageous for both contact surfaces to be convex. One contact surface, in particular the contact surface of the pump piston, is expediently planar. The planar contact surface is expediently arranged perpendicularly with respect to the longitudinal axis of the pump piston. However, it may be advantageous, particularly in order to compensate for tangentially acting dynamic forces, for the planar contact surface of the pump piston to be inclined relative to the longitudinal axis of the pump piston.

The contact surface of the piston-rod element is expediently curved concentrically with respect to the central axis of the eccentric cam. The concentric design of the contact surface has the effect that the forces which are introduced act directly on the central point of the eccentric cam, and a torque about the axis of the eccentric cam acting upon the piston-rod element is not produced. Provision is made for at least one contact surface to be curved spherically. At least one contact surface is advantageously curved cylindrically, in particular the contact surface having the smaller radius is curved spherically and the contact surface having the larger radius is curved cylindrically. In order to compensate for the dynamic inertia forces which occur and, in particular in the downstroke, to prevent a relative movement between the pump piston and piston-rod element, the contact surface of the piston-rod element may be convex, with that region of the contact surface which is in contact with the pump piston in the downstroke having a smaller radius of curvature. The smaller radius of curvature, which, in particular, is smaller than the spacing of the contact surface from the central axis of the eccentric cam, results in a torque which acts on the piston-rod element counter to the dynamic inertia forces.

In order to reduce the surface pressure and/or for adaptation to the size of the eccentricity of the eccentric cam, the end of the pump piston which is in contact with the surface of the piston-rod element may be provided with a larger diameter so as to enlarge the contact surface.

In order to provide for a compact design a plurality of piston-rod elements may be distributed around the circumference of the eccentric cam. In order to avoid the possibility of the piston-rod elements becoming detached in the radial direction from the eccentric cam during the down-stroke, fingers may protrude from each piston-rod element in the circumferential direction, which fingers engage adjacent piston-rod element with a small radial spacing. The fingers expediently extend from each piston-rod element in the circumferential direction towards both sides. Since there is always only one piston-rod element in a down-stroke mode, the adjacent piston-rod elements, which are pressed in the upstroke against the eccentric cam by the pump piston, can hold the piston-rod element, which is in the upstroke, in place. However, it may also be advantageous for the pump piston to be pressed against the piston-rod element by means of a spring. In this case, the fingers serve as a safety device in the event of a spring breakage. In order to avoid that the pump piston does not follow the piston-rod element in the down-stroke particularly if the spring breaks, provision is made for the pump piston to be held on the piston-rod element in a form-fitting manner, in particular by means of a clip. If the pump piston and piston rod elements are connected in a form-fitting manner, a spring does not have to be provided.

Substantially greater forces act between the piston-rod element and the pump piston in the upstroke than in the downstroke. In order to reduce the surface pressures in the upstroke, the longitudinal axis of the pump piston may be arranged in spaced relationship with respect to the camshaft axis. This offset enables the surface where the piston-rod element and pin are in contact in the upstroke to be shifted into the region of the pump-piston center.

At least one guide member is provided in order to limit the relative movement between the piston-rod element and pump piston in the circumferential direction of the eccentric cam. The guide member is expediently arranged approximately level with the contact surfaces and, in the circumferential direction, approximately in the center of the rolling region, since in this region the relative movement in the radial direction between the piston-rod element and pump piston is minimal. Guide members may also be arranged on both sides of the contact surfaces in the circumferential direction. The guide members extend approximately parallel to the piston longitudinal axis, in particular in the positions in which the pump piston has covered half the upstroke or half the downstroke. However, it may also be expedient for a guide structure to be arranged on the pump housing.

In order to reduce the surface pressure, the piston-rod element may be of multi-part design, the individual segments being arranged in the direction of the piston longitudinal axis and being moveable relative to one another on contact surfaces, and, in particular, the radii of curvature of the contact surfaces increasing outwards in the radial direction. As a result, a convexly curved contact surface rolls in each case on a concavely curved contact surface. The effective radius decisive for the Hertzian stress increases herein as the difference between the radii decreases. The arrangement of a plurality of parts of a piston-rod element thus enables the Hertzian stress to be reduced.

In order to reduce wear, the piston-rod element may have an insert made of wear-resistant material, in particular of anti-friction bearing steel or of ceramic, in the region of the contact surface. In order to reduce the friction and to improve the emergency running properties, a bearing-shell segment may be arranged on the piston-rod element between the piston-rod element and the eccentric cam, the said bearing-shell segment being, in particular, PTFE-coated. The bearing-shell segment is expediently soldered onto the piston-rod element, in particular with soft solder or with low-melting, silver-containing solder. In particular, the bearing-shell segment is fastened in a form-fitting manner, advantageously by bending it over and/or clipping it on. However, it may also be expedient for a bearing sleeve particularly one, which is coated with PTFE, to be arranged on the circumference of the eccentric cam.

Exemplary embodiments of the invention will be described below with reference to the drawing:

DESCRIPTION OF PREFERRED EMBODIMENTS

Figure 1:
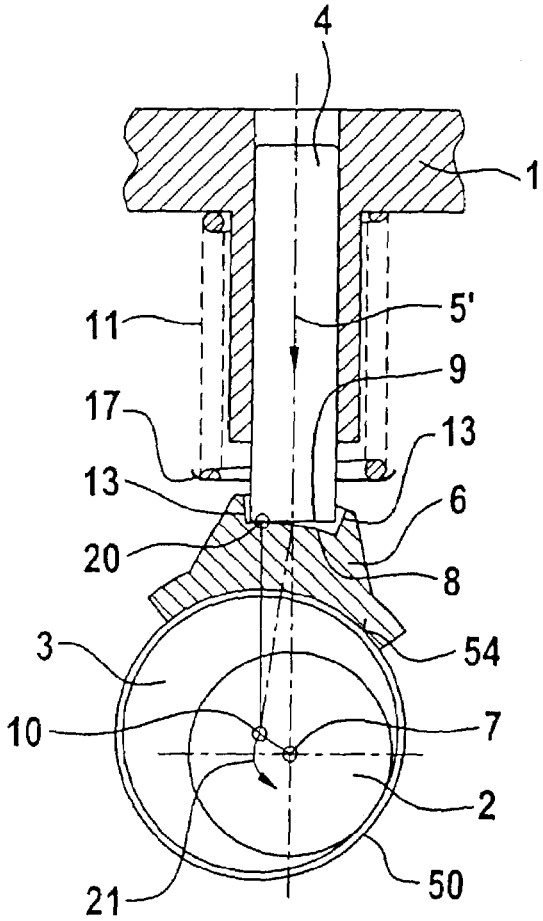
FIG. 1 is a diagrammatic illustration of a piston pump with a piston-rod element, which is arranged between the pump piston and an eccentric cam, in the downstroke.
Figure 2:
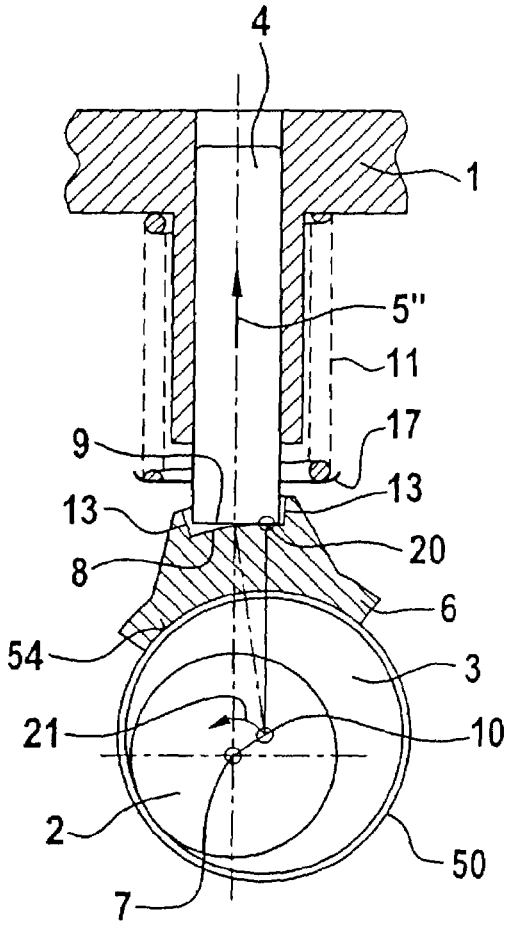
FIG. 2 is a diagrammatic illustration of the piston pump of FIG. 1 in the upstroke.

The coupling of a pump piston 4 to an eccentric cam 3 is illustrated diagrammatically in FIGS. 1 and 2. The pump piston 4 is mounted approximately radially with respect to the axis 7 of the camshaft 2 in a pump housing 1. The pump piston 4 is biased in the direction of the camshaft axis 7 by a compression spring 11. The compression spring 11 is supported at one end on the housing 1 and at the other end on a spring plate 17, which is fixed to the pump piston 4. An eccentric cam 3, the central axis 10 of which is spaced apart radially from the camshaft axis 7, is arranged on the camshaft 2.

A piston-rod element 6 is arranged between the eccentric cam 3 and pump piston 4. The piston-rod element 6 rests on a bearing sleeve 50, which is arranged on the circumference of the eccentric cam 3, and can rotate about the central axis 10 of the eccentric cam 3. In this case, the support surface 54 of the piston-rod element 6 surrounds the eccentric cam by less than 180°. With a contact surface 8, the piston-rod element 6 is in contact with the contact surface 9 of the pump piston 4. Rotation of the camshaft 2 causes the piston-rod element to execute a sinusoidal movement in the radial direction and a sinusoidal movement transversely thereto. The movement in the radial direction is transmitted to the pump piston 4, which executes a stroke movement 5 including a downstroke 5' and an upstroke 5".

In the case of the downstroke illustrated in FIG. 1, the contact surfaces 8 and 9 touch one another at the contact point 20, which may also be linear, depending on the design of the contact surfaces 8, 9. The pump piston 4 is pressed against the piston-rod element 6 by the spring 11 and therefore follows the eccentric cam 3 during the downstroke 5'. During the upstroke 5" illustrated in FIG. 2, the pump piston 4 is forced by the eccentric cam 3 via the piston-rod element 6 radially outwards from the cam center point against the force of the spring 11. During the stroke movement 5, the contact surfaces 8, 9 roll on each other. During rolling the stroke movement and the force are transmitted by the piston-rod element 6 to the pump piston 4.

Figure 3:
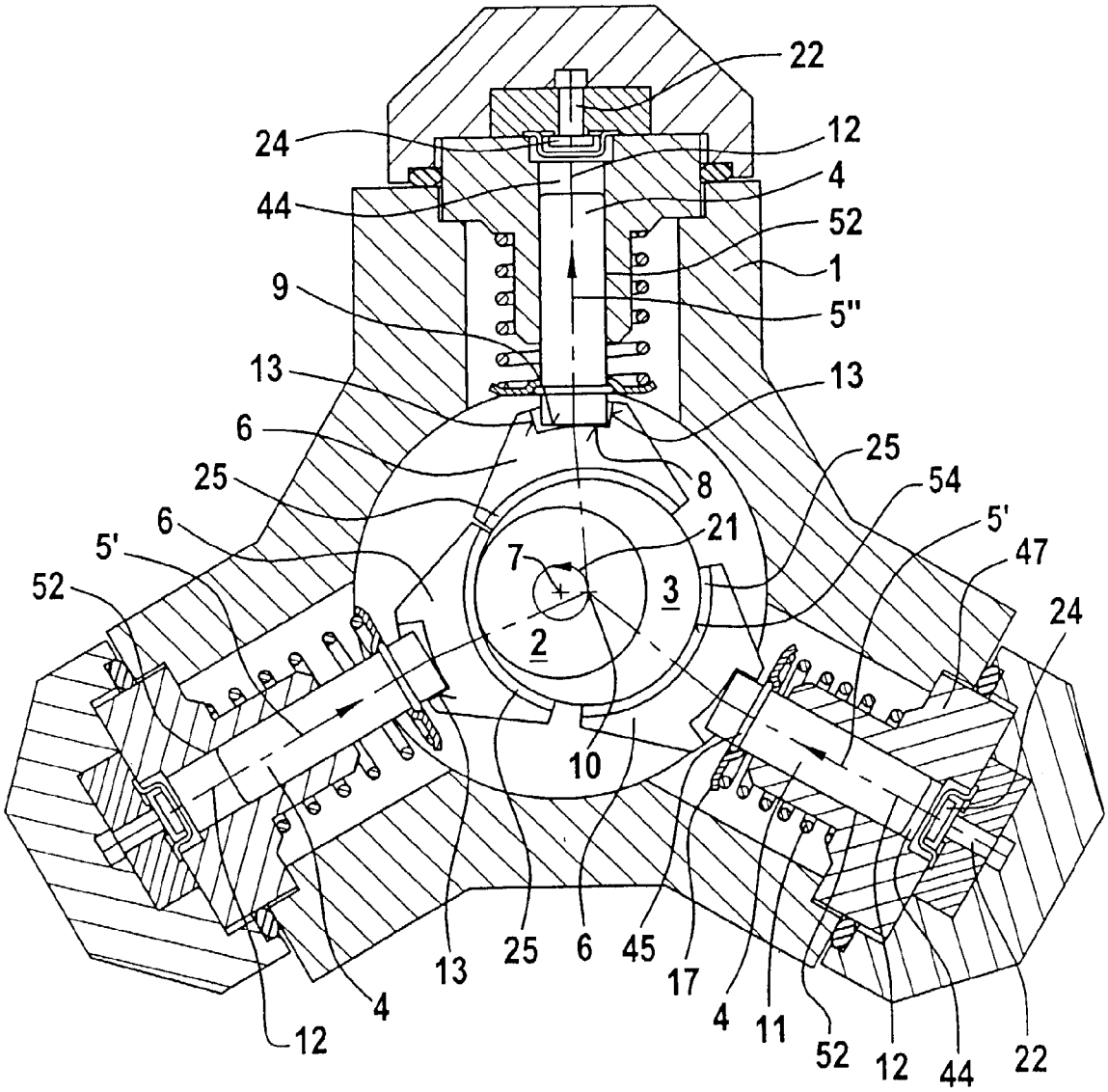
FIG. 3 shows a section through a piston pump with three radially arranged pump pistons.

FIG. 3 shows a piston pump having three pump pistons 4 arranged radially about the camshaft axis 7. The eccentric cam 3 is arranged on the camshaft 2. Three piston-rod elements 6 are distributed around the circumference of the eccentric cam 3 and in each case have a bearing-shell segment 25 with which they can slide on the eccentric cam 3. The piston-rod elements 6 can be moved relative to one another. On the side facing the pump piston 4, the piston-rod elements 6 have a contact surface 8, which can be formed, for example, from anti-friction bearing steel or ceramic. The contact surface 9 of the pump piston 4 is of planar design and is arranged perpendicularly with respect to the longitudinal axis 12 of the pump piston 4. The contact surface 8 of the piston-rod element 6 is curved concentrically with respect to the eccentric cam 3. The contact surface 8 is bounded in the circumferential direction by guide walls 13. The guide walls 13 extend approximately parallel to the longitudinal axis 12 of the pump piston 4 in the positions in which the pump piston 4 has covered half of the upstroke 5" or half of the downstroke 5'. The contact surface 8 is in contact with a contact surface 9 of the pump piston 4.

Formed above the piston-rod element 6, on the pump piston 4, is a bead 45 at which the spring plate 17 is held axially in the direction of the camshaft 2. However, it may be advantageous for the spring plate 17 to be held by a locking ring arranged in a groove of the pump piston 4. The spring 11 is supported radially to the inside against the spring plate 11 and radially to the outside against an insert 47, which is fixed on the housing and which has a bore 52 in which the pump piston 4 is guided. The pump chamber 44, into which fuel can flow via a valve 24, which is designed, in particular, as a nonreturn valve, is formed at the end of the pump piston 4. A nonreturn valve (not illustrated) in the outlet prevents the fuel fed into the high-pressure tank during the upstroke 5" from flowing back into the pump chamber 44.

During rotation of the camshaft 2, the eccentric cam 3 actuates the pump pistons 4 successively via the piston-rod elements 6. In the downstroke 5', fuel is sucked into the pump chamber 44 via the inlet 22 and the valve 24. The valve in the outlet is closed. The pump piston 4 is pressed against the piston-rod element 6 by the spring 11. During the upstroke 5", the piston-rod element presses the piston 4 radially to the outside against the force of the spring 11 and the hydraulic pressure, as a result of which the fuel in the pump chamber 44 is pressed through the nonreturn valve in the outlet, which valve automatically opens during the upstroke 5", into a high-pressure tank. During the stroke movement, the piston-rod elements 6 and the pump pistons 4 roll on one another on the contact surfaces 8 and 9. Since the forces always act perpendicularly on the surfaces, the pump piston is always acted upon only by a force parallel to the longitudinal axis 12 while the piston-rod element 6 is acted upon by a force in the direction of the center point of the eccentric cam. As a result, a torque about the central axis 10 of the eccentric cam is not transmitted to the piston-rod element 6. The rolling movement means that there is no sliding movement between the pump piston 4 and piston-rod element 6.

Figure 4:
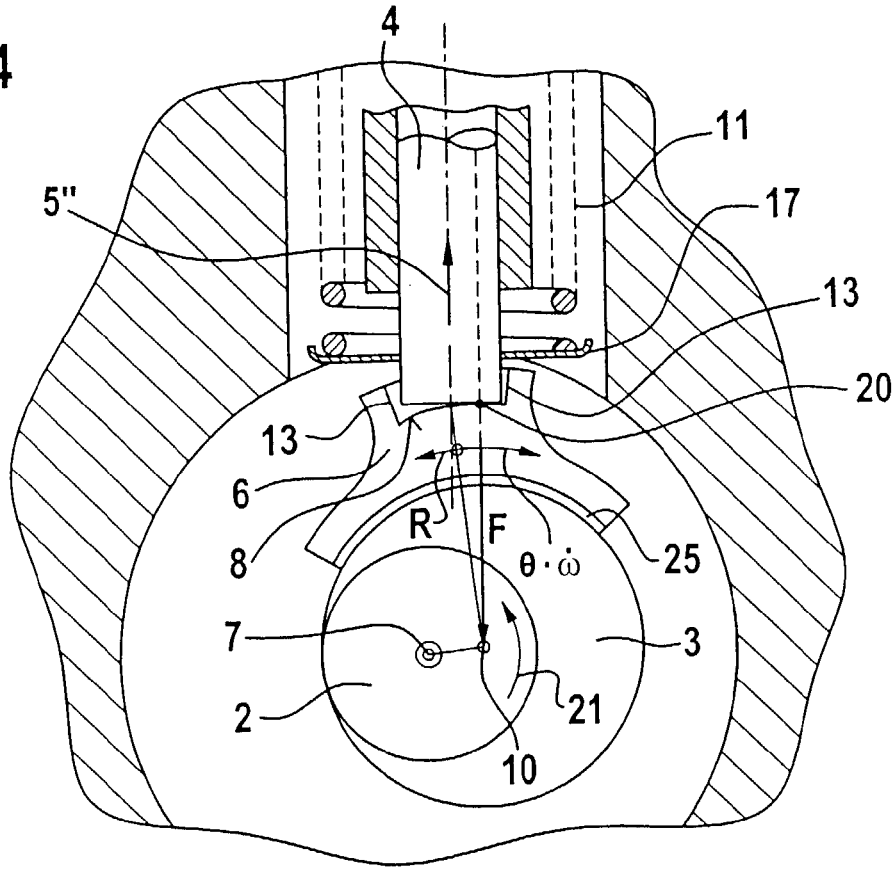
FIG. 4 is, in a sectional illustration, showing a detail of a piston pump in the upstroke.
Figure 5:
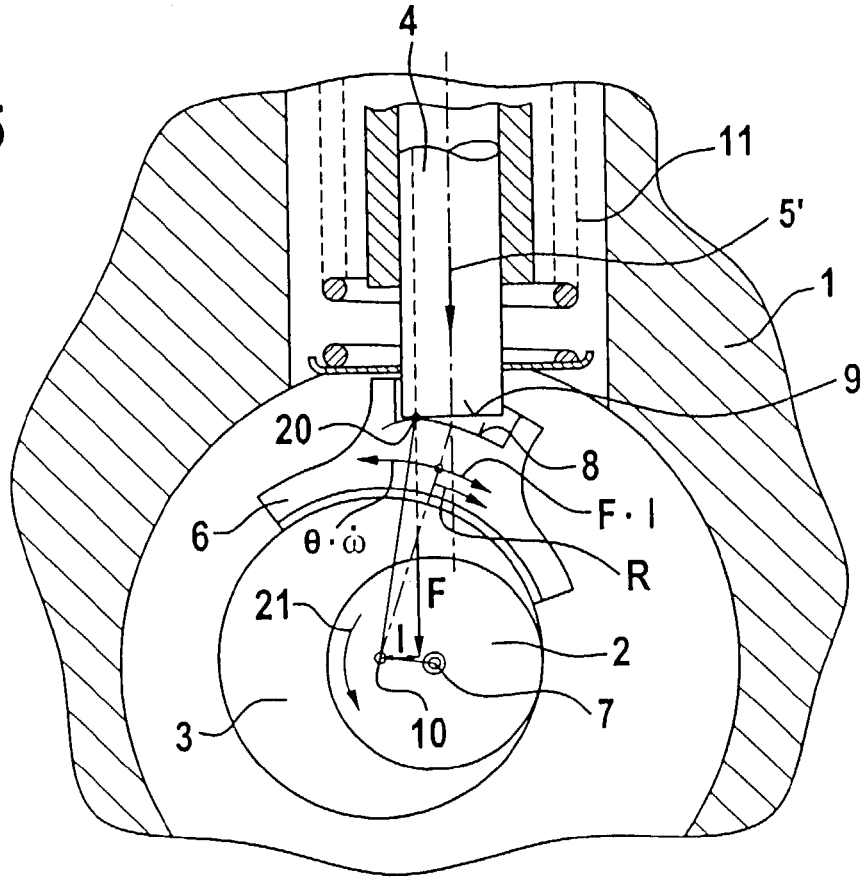
FIG. 5 shows the detail from FIG. 4 with the pump piston in the downstroke.

The forces, which are in effect, are illustrated diagrammatically in FIGS. 4 and 5. FIG. 4 shows a piston 4 during the upstroke 5". Owing to the sinusoidal movement in the horizontal direction, dynamic inertia forces $\theta\cdot\omega$ act on the piston-rod element 6. The frictional force R, which acts between the piston-rod element 6 and pump piston 4, counteracts the inertia forces. In the upstroke 5", the force F and hence also the frictional force R are very large, with the result that, in spite of the inertia forces $\theta\cdot\omega$, sliding between the piston-rod element 6 and pump piston 4 cannot occur. Since the contact surface 8 of the piston-rod element 6 is formed concentrically with respect to the central axis 10 of the eccentric cam at the contact point 20 in that instance, the force F acts directly on the central axis 10. The force F corresponds approximately to the pressure of the fuel in the pump chamber 44 (illustrated in FIG. 3) multiplied by the surface area of the pump piston 4.

In the down-stroke 5', which is illustrated in FIG. 5, the lower pressure in the pump chamber 44 means that the force F is likewise lower. The frictional force R also counteracts the dynamic inertia force $\theta^*\omega$ here. However, the lower force F means that the frictional force R is also substantially lower. The contact surface 8 of the piston-rod element 6 has, at the contact point 20 at that instance, a radius which is smaller than the spacing between the contact surface 8 and central axis 10 of the eccentric cam 3. As a result, the force F does not act on the central axis 10, but at a distance 1 therefrom. This produces a torque about the central axis 10 which counteracts the dynamic inertia force $\theta^*\omega$ and therefore prevents sliding.

Figure 6:
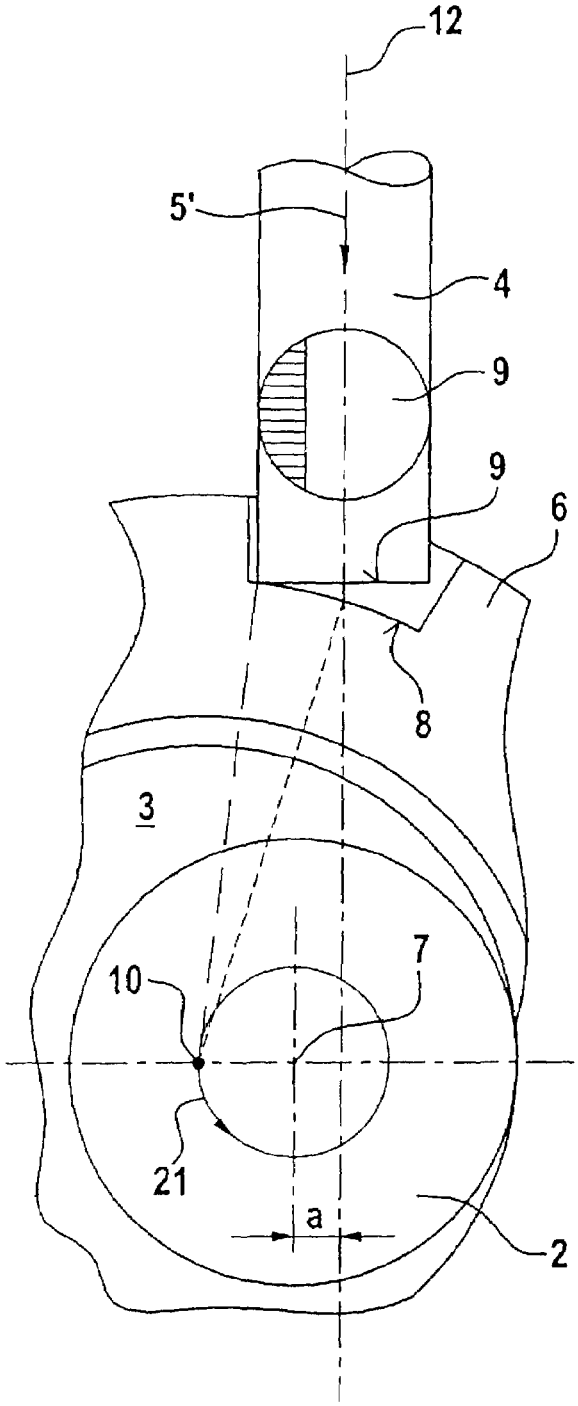
FIG. 6 is a diagrammatic illustration of the pump piston, piston-rod element and eccentric cam with an axial offset between the pump piston and camshaft axis in the downstroke.
Figure 7:
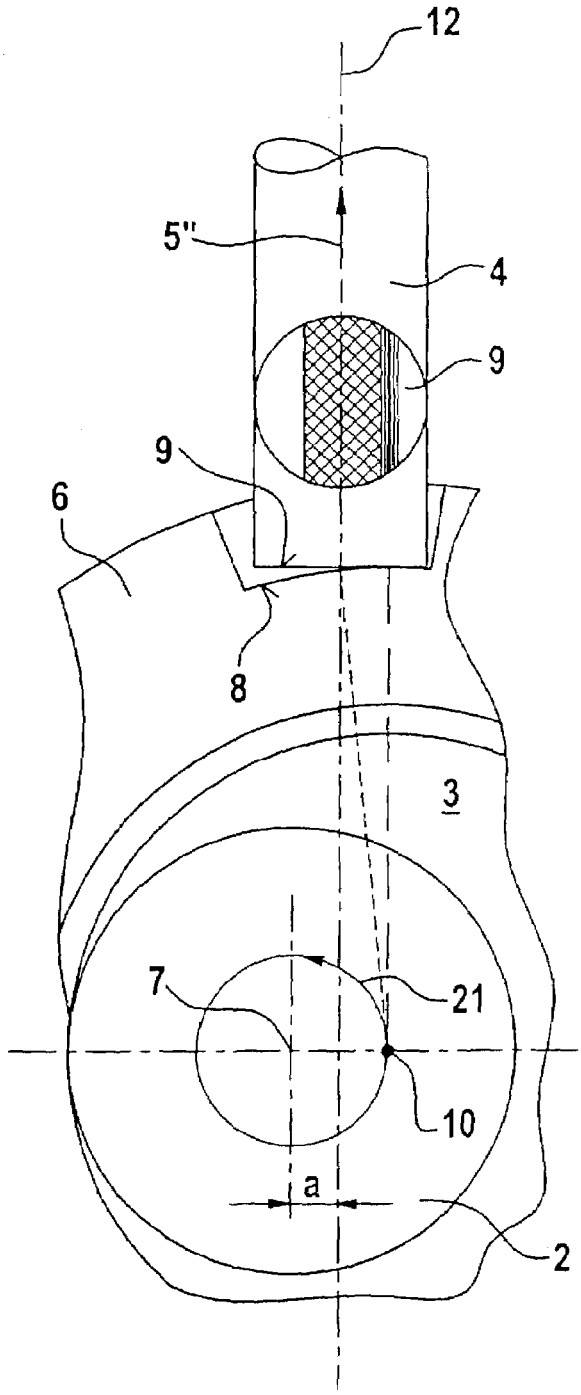
FIG. 7 is a diagrammatic illustration of the arrangement from FIG. 6 in the upstroke.

FIGS. 6 and 7 diagrammatically illustrate a pump piston 4 in the downstroke 5' and in the upstroke 5". The rolling regions in the contact surface 9 are illustrated on the pump piston 4. The longitudinal axis 12 of the piston 4 is spaced from the camshaft axis 7. FIG. 6 shows the piston 4 in the position in which the pump piston 4 has covered half of the downstroke 5'. The distance a between the camshaft axis 7 and piston longitudinal axis 12 leads to a reduction in the contact surface in the downstroke 5'. Since the surface pressures also depend on the contact surface, they are increased as a result. Since, however, only low forces act on the pump piston 4 in the downstroke 5', this does not result in impermissibly high surface pressures.

In the case of the upstroke 5" illustrated in FIG. 7, the rolling region between the pump piston and piston rod element 6 is displaced toward the center of the pump piston 4. Because of the circular cross section of the pump piston 4, this results in an increase in the amount of contact surface 9 which is loaded in the upstroke 5" and therefore to a reduction in the surface pressures. The surface pressures which occur in a cylindrical pump piston 4 can therefore be reduced by an offset between the camshaft and piston longitudinal axis by the distance a.

Figure 8:
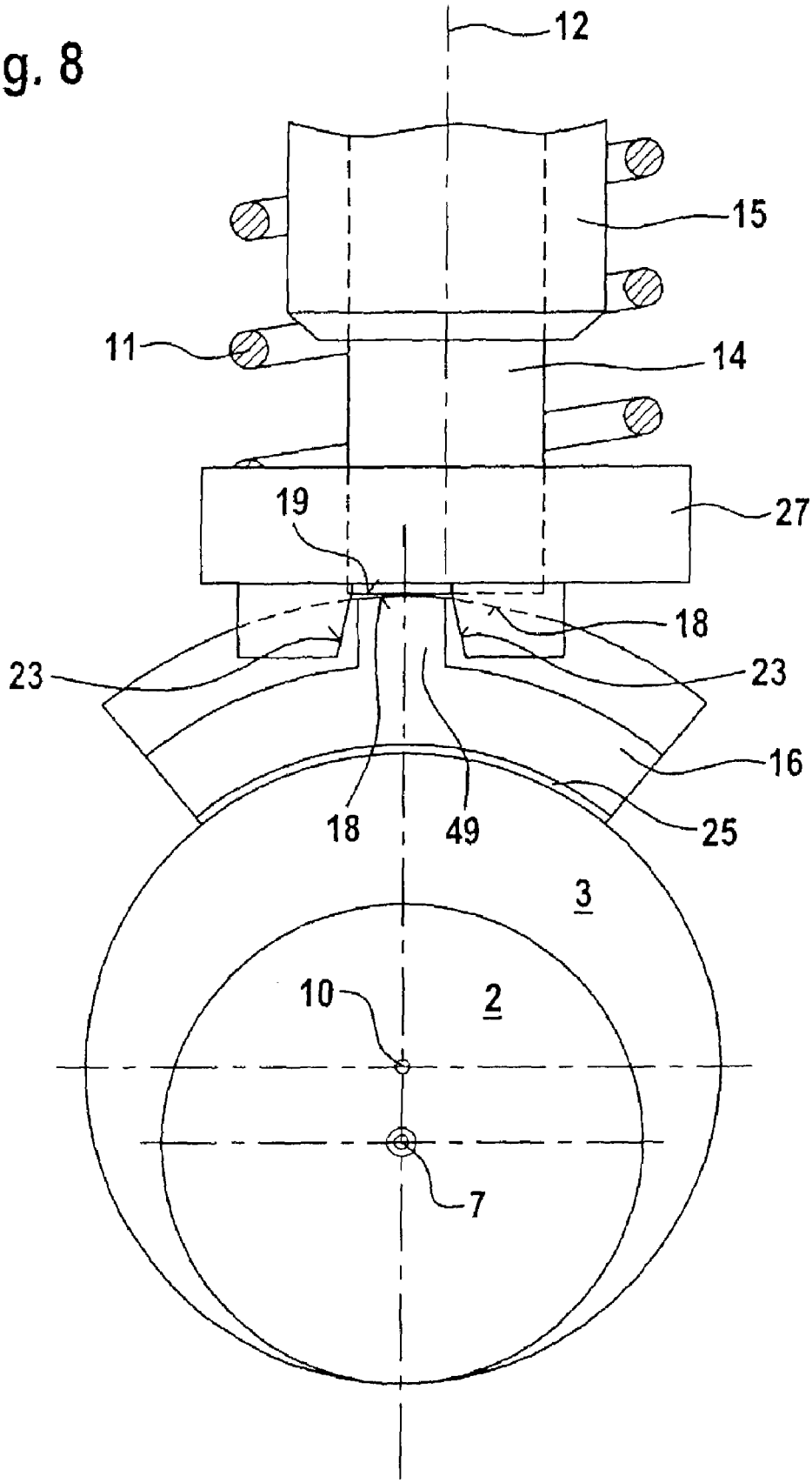
FIG. 8 is a diagrammatic illustration of a design variant of the pump piston spring plate with a guide for the piston-rod element and piston-rod element.

FIG. 8 diagrammatically illustrates a design variant. The pump piston 14, the contact surface 19 of which faces the piston-rod element 16, and interacts with the contact surface 18 of the piston-rod element 16, is guided in the pump cylinder 15. The piston-rod element 16 is arranged via a bearing-shell segment 25 on an eccentric cam 3 and is actuated by the latter, as already described. The spring 11 is fixed in place in the axial direction by the spring plate 27, which is fixed on the pump piston 14. Arranged on that side of the spring plate 27 which faces the piston-rod element 16 are guides 23 which extend both in the direction of the pump piston 14 and in the direction of the piston-rod element 16 from the region of the contact surfaces 18 and 19.

The contact surface 19 of the pump piston 14 is planar and extends perpendicularly to the longitudinal axis 12 of the pump piston 14. The contact surface 18 of the piston-rod element 16 is curved concentrically with respect to the central axis 10 of the eccentric cam 3. The guide pin 49 arranged on the piston-rod element 16 reaches between the guide walls 23 arranged on the spring plate 27. The side walls of the guide pin 49 extend parallel to the guide walls 23 in the positions in which the pump piston 4 has covered half of the downstroke 5' or half of the upstroke 5". The guide walls 23 prevent a relative movement between the piston-rod element 16 and the pump piston 14 in the circumferential direction. Since the relative movement in the radial direction level with the contact surfaces 18, 19 is minimal, there will be only minimal radial relative movement and therefore virtually no wear in the contact points of the guides 23 and guide pin 49 when the contact points between the guides 23 and guide pin 49 are arranged in this radial region. In order to achieve small surface pressures during the transfer of the compressive forces from the piston-rod element 16 to the pump piston 14, the longitudinal axis 12 of the pump piston 14 is also offset relative to the camshaft axis 7.

Figure 9:
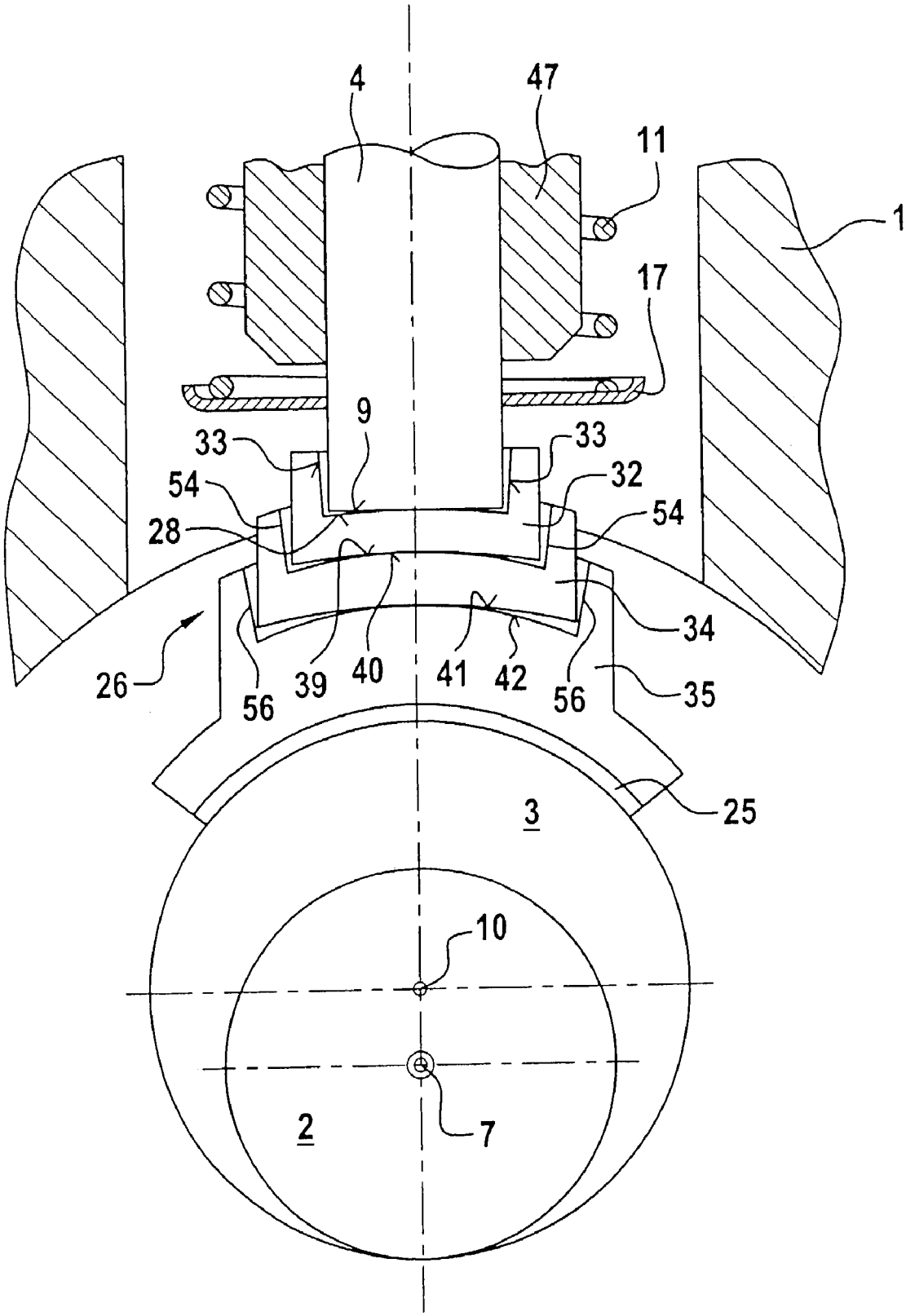
FIG. 9 is a diagrammatic illustration of a further design variant of the piston-rod element.

FIG. 9 illustrates an exemplary embodiment for a piston-rod element 26, which is of multi-part design. The piston-rod element 26 has three cup-shaped segments, which are arranged one above another in the radial direction with respect to the eccentric cam 3. The inner segment 35 has a contact surface 25 with which it is supported on the eccentric cam. On the radially outer side, the segment 35 has a contact surface 42 which is curved convexly and which has guides 56 in the circumferential direction. The segment 34, the outside diameter of which corresponds approximately to the inside diameter on the contact surface 42, is arranged radially outwards on the segment 35. That contact surface 41 of the segment 34 which faces the segment 35 is curved concavely, with the radius of the contact surface 41 being greater than the radius of the contact surface 42.

On the radially outwardly facing side, the segment 34 has a contact surface 40 which is curved convexly, with this radius of curvature having the same center point as the radius of curvature of the contact surface 41. The segment 34 also has guides 57 in the circumferential direction. Arranged radially outside the segment 34 is the segment 32, whose contact surface 39, which faces the segment 34, is curved convexly and rolls on the contact surface 40 while the radially outwardly facing contact surface 28 is in contact with the pump piston 4 via the contact surface 9. The segment 32 has guides 33 in the circumferential direction. During movement of the eccentric cam 3, the segments 32, 34 and 35 of the piston-rod element 26 roll on one another. Small surface pressures are produced because of the relatively small differences between the radii of the surfaces rolling on one another. Piston-rod elements, which are formed only from two or from more than three segments, may also be advantageous.

Figure 10:
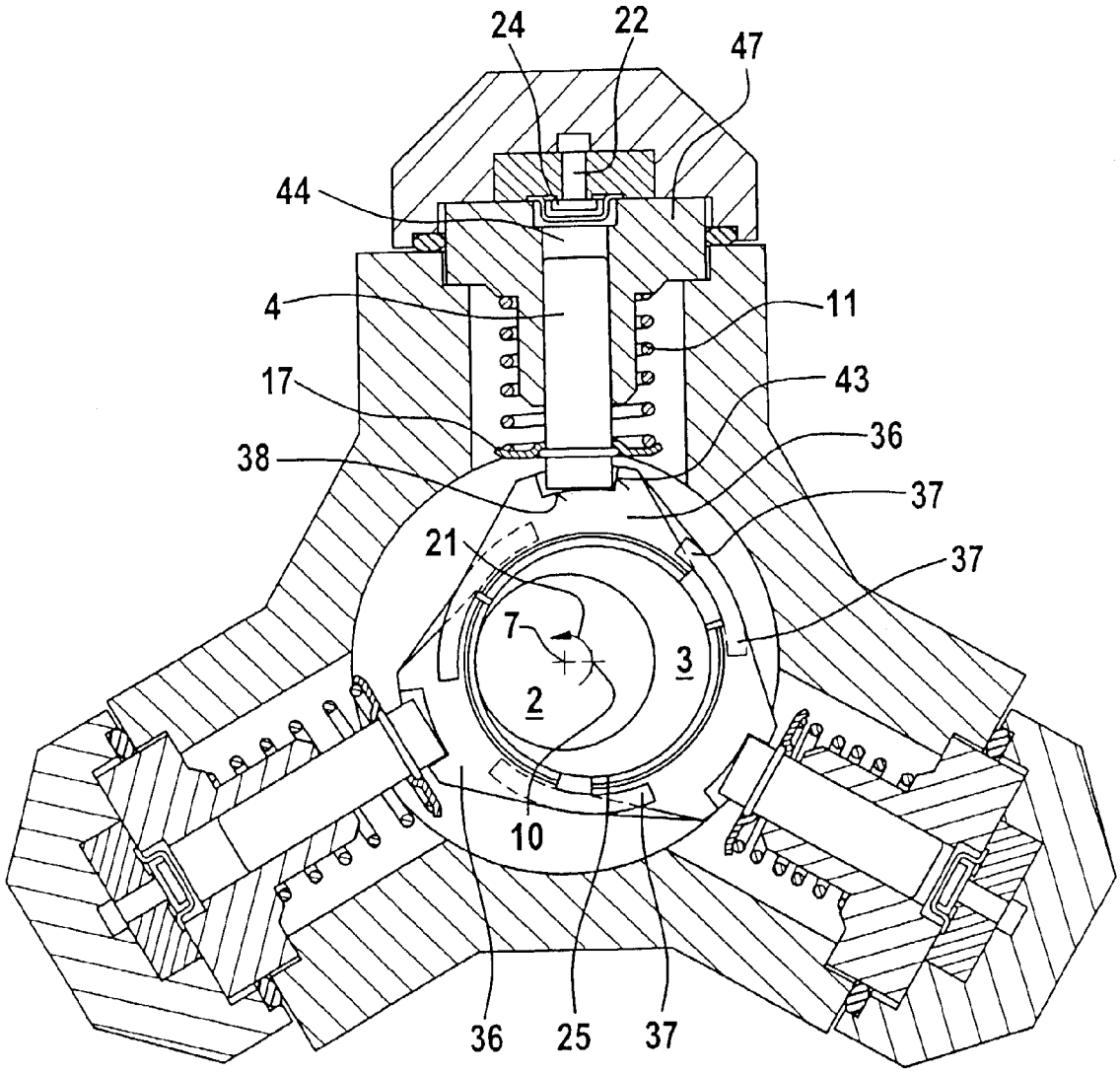
FIG. 10 is a sectional illustration of a further design variant of a piston-rod element.

The piston pump illustrated in FIG. 10 corresponds largely in its function and its construction to the piston pump shown in FIG. 3. Arranged on the circumference of the eccentric cam 3 are three piston-rod elements 36, which are supported on the eccentric cam 3 via bearing-shell segments 25. The piston-rod elements 36 act on the pump piston 4 via contact surfaces 38. The movement in the circumferential direction between the piston-rod element 36 and pump piston 4 is limited by guides 43, which are arranged on both sides of the contact surfaces 38 in the circumferential direction. The piston-rod elements 36 have lugs 37 pointing towards the adjacently arranged piston-rod elements 36 on both sides in the circumferential direction, the lugs 37 engaging at a small radial spacing over the respective adjacent piston-rod element 36. Since at least one pump piston always executes an upstroke 5" and a large force F acts on the corresponding piston-rod element 36 in the direction of the central axis 10 of the eccentric cam 3, the piston-rod elements 36 secure one another in the radial direction via the lugs 37. Even if a spring 11 breaks, this avoids a piston-rod element 36 from lifting off the eccentric cam 3 to too great an extent, thereby preventing, for example, blocking the pump.

Figure 11:
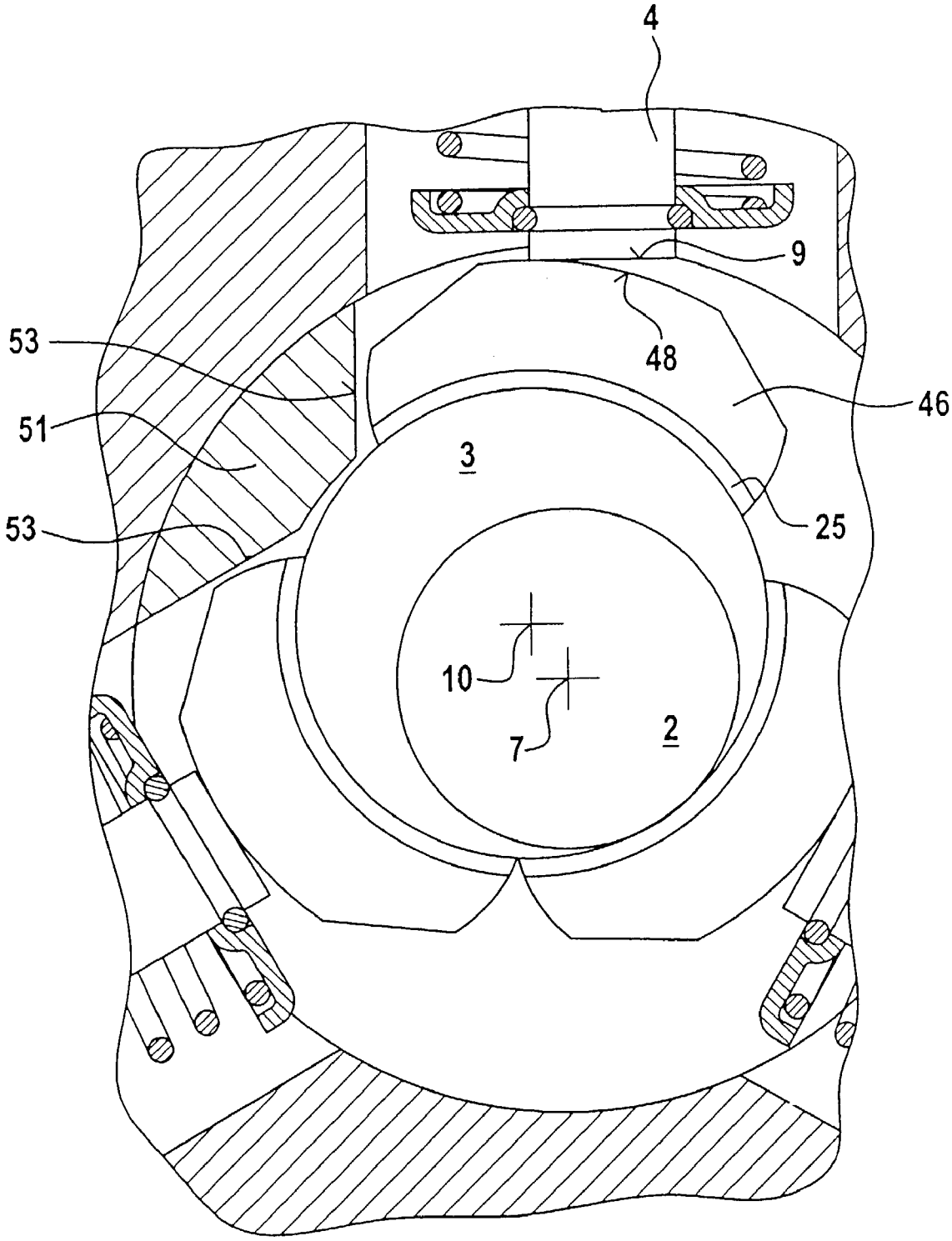
FIG. 11 is a sectional illustration of a further design variant of the piston-rod elements and of the guides.

FIG. 11 illustrates a further embodiment in a sectional view. Arranged in the radial direction of the eccentric cam 3 are three piston-rod elements 46, which are supported on the eccentric cam via bearing-shell segments 25. The radially outwardly pointing contact surfaces 48 of the piston-rod elements 46 are curved concentrically with respect to the central axis 10 of the eccentric cam 3 and roll on the contact surfaces 9 of the pump pistons 4. In order to prevent a relative movement between the pump piston 4 and piston-rod element 46, a stop 51, which has two lateral guide walls 53, is arranged on the housing. The adjacent piston-rod elements 46 can butt in the circumferential direction against these guide walls 53 and the central piston-rod element 46 can in turn butt against the adjacent piston-rod elements 46 in their extreme positions, with the result that sliding of the contact surfaces 9 and 48 on each other is avoided. At the same time, it is avoided that a piston-rod element 46 can be removed to such an extent from the associated pump piston 4 in the circumferential direction that the pump piston 4 is no longer in contact with the contact surface 48. However, it may also be advantageous to provide for each piston-rod element 46 a guide wall 53 fixed on the housing.

The piston-rod elements are advantageously produced from cost-effective materials by machining, shaping or casting. In the region of the contact surfaces, the piston-rod elements advantageously have an insert made of hard and wear-resistant material. This may advantageously be anti-friction bearing steel or ceramic. The bearing-shell segments, which are arranged between the piston-rod element and the eccentric cam 3, are expediently coated with a layer having good emergency running properties, for example PTFE. The bearing-shell segments can be soldered onto the piston-rod elements, in particular with a low-melting solder, for example soft solder or silver-containing solder having a melting point of approximately 220° C. However, it may also be expedient for the bearing-shell segments to be riveted on the piston-rod elements or to be bent over and/or clipped on at the bearing-shell edges. Instead of the bearing-shell segments, it may also be expedient for a bearing sleeve to be fitted on the circumference of the eccentric cam, which bearing sleeve can, in particular, be shrunk on and can be coated, for example, with PTFE.

The piston-rod elements are expediently mounted through the walls of the pump housing 1 in the direction of the central axis 10 of the eccentric cam 3. However, it may also be expedient to mount the piston-rod elements via the pump piston 4 by means of a corresponding connection. The contact surfaces may be of planar design in the direction of the central axis 10, so that planar or cylindrical contact surfaces are produced. However, it may also be advantageous for the contact surfaces to be curved in the direction of the central axis 10, as a result of which, in particular, spherically curved contact surfaces are produced. In an advantageous manner, the contact surface having the smaller radius value is curved spherically and the contact surface having the larger radius is curved cylindrically.

Figure 12:
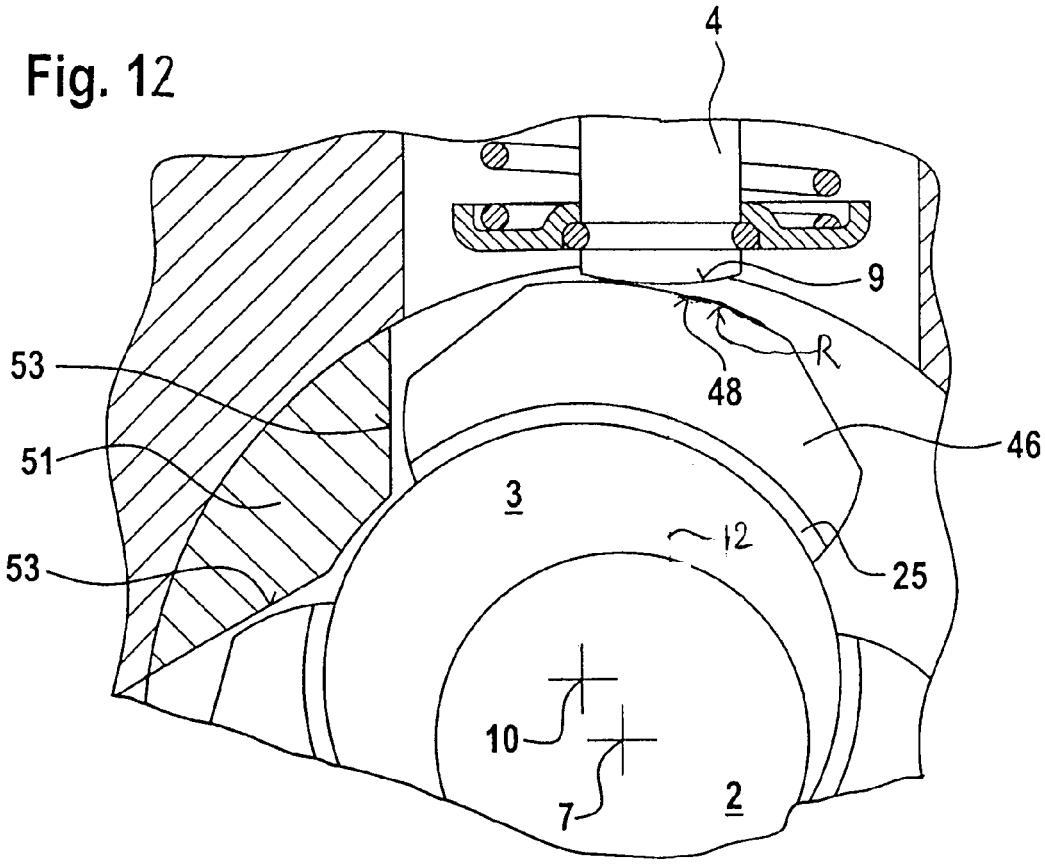
FIG. 12 shows an arrangement with curved engagement surfaces of the piston and the piston rod element.

FIG. 12 shows the pump piston 4 with a curved surface rolling on the curved surface 48 of the piston rod element 46. The curved surface 48 may include a region R with a somewhat reduced radius of curvature.

Figure 13:
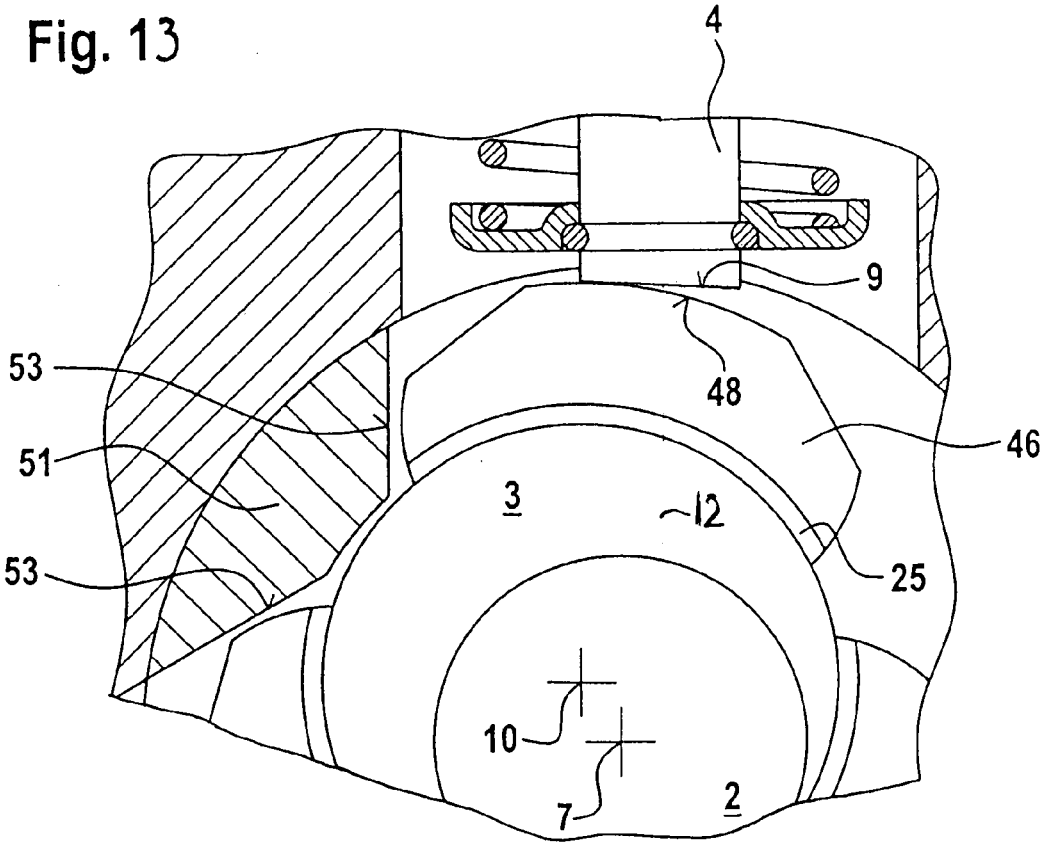
FIG. 13 shows an arrangement with curved contact surface of the piston rod element and a flat piston end face which however is slightly inclined.

FIG. 13 shows the surface 48 of the piston rod element curved convexly and in contact with the flat surface 9 of the piston, which flat surface 9 however is slightly inclined with respect to the longitudinal axis of the piston 4 or rather to a plane extending normal to the longitudinal axis of the piston 4.

The invention claimed is:

1. A piston pump for producing high-pressure fuel in common-rail fuel injection systems, said pump having a pump housing (1), a camshaft (2) mounted rotatably in said pump housing (1) and having an eccentric cam (3), for operating at least one pump piston (4, 14) supported in a cylinder so as to be movable in an approximately radial direction with respect to the camshaft (2) to provide a stroke movement, the stroke movement comprising a downstroke (5') towards the camshaft (2) and an opposite upstroke (5"), and a piston-rod element (6, 16, 26, 36, 46) arranged between each pump piston (4, 14) and the eccentric cam (3), the piston rod element (6, 16, 26, 36, 46) and the piston (4, 14) having opposite contact surfaces for transferring the stroke movement of the eccentric cam (3) to the pump piston (4, 14), the opposite contact surfaces being both convex so as to roll off on one another.

2. A piston pump according to claim 1, wherein a bearing surface (54) of the piston-rod element (6, 16, 26, 36, 46) which is supported on the eccentric cam (3) is in contact with the eccentric cam (3) over an angle of less than 180°.

3. A piston pump according to claim 1, wherein a plurality of pump pistons (4, 14) are provided, and each piston-rod element (6, 16, 26, 36, 46) is movable over a predetermined angular range about the center axis (10) of the eccentric cam (3) independently of other piston-rod elements (6, 16, 26, 36, 46).

4. A piston pump according to claim 1, wherein the contact surface (8, 18, 28, 38, 48) of the piston-rod element (6, 16, 26, 36, 46) is curved concentrically with the central axis (10) of the eccentric cam (3).

5. A piston pump according to claim 1, wherein at least one contact surface (8, 18, 28, 38, 48; 9, 19) is curved partially spherically.

6. A piston pump according to claim 1, wherein at least one of the convex contact surface (8, 18, 28, 38, 48; 9, 19) is curved partially cylindrically.

7. A piston pump according to claim 6, wherein the contact surface having the smaller radius is curved partially spherically and the contact surface having the larger radius is curved partially cylindrically.

8. A piston pump according to claim 1, wherein the contact surface (8, 18, 28, 38, 48) of the piston-rod element (6, 16, 26, 36, 46) is convex, and a region (R) of the contact surface (8, 18, 28, 38, 48) which is in contact with the pump piston (4, 14) in the downstroke (5') has a reduced radius of curvature.

9. A piston pump according to claim 1, wherein a plurality of piston-rod elements (6, 16, 26, 36, 46) and pistons are distributed around the circumference of the eccentric cam (3).

10. A piston pump according to claim 1, wherein the pump piston (4, 14) is pressed against the piston-rod element (6, 16, 26, 36, 46) by means of a spring (11).

11. A piston pump according to claim 1, wherein the pump piston (4, 14) has a longitudinal axis (12) and is arranged so that its longitudinal axis (12) is spaced from the camshaft axis (7).

12. A piston pump according to claim 1, wherein at least one guide structure (13, 23, 33, 43, 53) is provided, for limiting the relative movement between the piston-rod element (6, 16, 26, 36, 46) and the pump piston (4, 14) in the circumferential direction of the eccentric cam (3).

13. A piston pump according to claim 12, wherein the guide structure (13) is arranged approximately level with the contact surfaces (8, 18, 28, 38, 48; 9, 19) of the piston and the piston rod element.

14. A piston pump according to claim 12, wherein said at least one guide structure (13, 33, 43) is arranged on the piston-rod element (6, 26, 36).

15. A piston pump according to claim 12, wherein at least one guide means (23) is arranged on the pump piston (4, 14).

16. A piston pump according to claim 12, wherein guide structures (13, 23, 33, 43) are arranged at opposite ends of the contact surfaces (8, 18, 28, 38, 48; 9, 19) for abutting the pump piston at the limits of the relative movement.

17. A piston pump according to claim 12, wherein said guide structures (13, 33, 43) extend approximately parallel to the longitudinal piston axis (12) in the positions in which the pump piston (4) is about midway between its top and bottom end positions.

18. A piston pump according to claim 12, wherein a guide (53) is arranged on the pump housing (1) for limiting circumferential movement of said piston rod elements.

19. A piston pump according to claim 1, wherein the piston-rod element (6, 16, 26, 36, 46) includes in the region of the contact surface (8, 18, 28, 38, 48) an insert made of wear-resistant material.

20. A piston pump according to claim 1, wherein a bearing-shell segment (25) is arranged on the piston-rod element (6, 16, 26, 36, 46) between the piston-rod element (6, 16, 26, 36, 46) and the eccentric cam (3).

21. A piston pump according to claim 20, wherein the bearing-shell segment (25) is soldered onto the piston-rod element (6, 16, 26, 36, 46).

22. A piston pump according claim 1, wherein a bearing sleeve (50) is arranged on the circumference of the eccentric cam (3).

23. A piston pump for producing high-pressure fuel in common-rail fuel injection systems, said pump having a pump housing (1), a camshaft (2) mounted rotatably in said pump housing (1) and having an eccentric cam (3) for operating at least one pump piston (4, 14) supported in a cylinder so as to be movable in an approximately radial direction with respect to the camshaft (2) to provide a stroke movement, the stroke movement comprising a downstroke (5') towards the camshaft (2) and an opposite upstroke (5"), and a piston-rod element (6, 16, 26, 36, 46) arranged between each pump piston (4, 14) and the eccentric cam (3), the piston rod element, (6, 16, 26, 36, 46) and the piston (4, 14) having opposite contact surfaces for transferring the stroke movement of the eccentric cam (3) to the pump piston (4, 14), one of the contact surfaces (8, 18, 28, 38, 48; 9, 19) being convex and the other being concave and having a radius which is greater than the radius of the convex contact surface so as to roll off one another.

24. A piston pump for producing high-pressure fuel in common-rail fuel injection systems, said pump having a pump housing (1), a camshaft (2) mounted rotatably in said pump housing (1) and having an eccentric cam (3) for operating at least one pump piston (4, 14) supported in a cylinder so as to be movable in an approximately radial direction with respect to the camshaft (2) to provide a stroke movement, the stroke movement comprising a downstroke (5') towards the camshaft (2) and an opposite upstroke (5"), and a piston-rod element (6, 16, 26, 36, 46) arranged between each pump piston (4, 14) and the eccentric cam (3), the piston rod element, (6, 16, 26, 36, 46) and the piston (4, 14) having opposite contact surfaces for transferring the stroke movement of the eccentric cam (3) to the pump piston (4, 14), the contact surface of the piston rod element (6, 16, 26, 36, 46) being convex and the contact surface (9, 19) of the pump piston (4, 14) being planar and inclined relative to the longitudinal axis (12) of the pump piston (4, 14).

25. A piston pump for producing high-pressure fuel in common-rail fuel injection systems, said pump having a pump housing (1), a camshaft (2) mounted rotatably in said pump housing (1) and having an eccentric cam (3) for operating at least one pump piston (4, 14) supported in a cylinder so as to be movable in an approximately radial direction with respect to the camshaft (2) to provide a stroke movement, the stroke movement comprising a downstroke (5') towards the camshaft (2) and an opposite upstroke (5"), and a piston-rod element (6, 16, 26, 36, 46) arranged between each pump piston (4, 14) and the eccentric cam (3), the piston rod element, (6, 16, 26, 36, 46) and the piston (4, 14) having opposite contact surfaces for transferring the stroke movement of the eccentric cam (3) to the pump piston (4, 14), a plurality of piston rod elements (6, 16, 26, 36, 46) and pistons (4) being distributed around the circumference of the eccentric cam (3), with fingers (37) protruding from each piston-rod element (36) in the circumferential direction, said fingers (37) extending with a small radial spacing over the outer side of the respective, adjacent piston-rod element (36).

26. A piston pump for producing high-pressure fuel in common-rail fuel injection systems, said pump having a pump housing (1), a camshaft (2) mounted rotatably in said pump housing (1) and having an eccentric cam (3) for operating at least one pump piston (4, 14) supported in a cylinder so as to be movable in an approximately radial direction with respect to the camshaft (2) to provide a stroke movement, the stroke movement comprising a downstroke (5') towards the camshaft (2) and an opposite upstroke (5"), and a piston-rod element (6, 16, 26, 36, 46) arranged between each pump piston (4, 14) and the eccentric cam (3), the piston rod element, (6, 16, 26, 36, 46) and the piston (4, 14) having opposite contact surfaces for transferring the stroke movement of the eccentric cam (3) to the pump piston (4, 14), the piston-rod element (26) being of a multi-part design, the individual parts (32, 34, 35) being arranged adjacent one another in the direction of the piston longitudinal axis (12) and being rollably supported on one another on curved contact surfaces (39, 40, 41, 42), having radii of curvature which increase with increasing distance from the camshaft (2).

* * * * *